US007825862B2

(12) United States Patent
Cheng et al.

(10) Patent No.: US 7,825,862 B2
(45) **Date of Patent: *Nov. 2, 2010**

(54) ANTENNA DEVICE WITH SURFACE ANTENNA PATTERN INTEGRALLY COATED CASING OF ELECTRONIC DEVICE

(75) Inventors: Yu-Chiang Cheng, Taipei (TW); Ping-Cheng Chang, Chaozhou Town, Pingtung County (TW); Cheng-Zing Chou, Xinying (TW)

(73) Assignee: Getac Technology Corporation, Hsinchu (TW)

( * ) Notice: Subject to any disclaimer, the term of this patent is extended or adjusted under 35 U.S.C. 154(b) by 83 days.

This patent is subject to a terminal disclaimer.

(21) Appl. No.: 11/898,525

(22) Filed: Sep. 13, 2007

(65) Prior Publication Data

US 2008/0297420 A1 Dec. 4, 2008

(30) Foreign Application Priority Data

Jun. 1, 2007 (TW) ..... 96119839 A

(51) Int. Cl.
*H01Q 1/24* (2006.01)

(52) U.S. Cl. ..... 343/702; 343/700 MS

(58) Field of Classification Search ..... 343/702, 343/700 MS

See application file for complete search history.

(56) References Cited

U.S. PATENT DOCUMENTS

| | | | |
|---|---|---|---|
| 5,434,579 | A | 7/1995 | Kagoshima et al. |
| 5,677,698 | A | 10/1997 | Snowdon |
| 6,396,444 | B1 | 5/2002 | Goward et al. |
| 6,667,719 | B2 | 12/2003 | LaKomski |
| 7,339,533 | B2 | 3/2008 | Kurashima et al. |
| 7,671,809 | B2 | 3/2010 | Cheng et al. |
| 7,768,461 | B2 | 8/2010 | Cheng et al. |
| 2002/0075186 | A1 | 6/2002 | Hamada et al. |
| 2002/0089456 | A1 | 7/2002 | Hamada et al. |
| 2003/0181227 | A1 | 9/2003 | Toshiyuki |

(Continued)

FOREIGN PATENT DOCUMENTS

| | | |
|---|---|---|
| DE | 10119531 | 10/2002 |

(Continued)

OTHER PUBLICATIONS

Y.Q. Wang et al, "Polymer Modification by Ion Implantation: Electrical Conductivity and Applications," Desk Reference of Functional Polymers Syntheses and Applications, American Chemical Society, pp. 387-404, Washington DC,1997.

(Continued)

*Primary Examiner*—Douglas W Owens
*Assistant Examiner*—Dieu Hien T Duong

(57) ABSTRACT

An antenna device with a surface antenna pattern is formed either on an internal surface or on the external surface of a casing of an electronic device by film coating technology. The surface antenna pattern is either directly connected to a signal feeding line or connected to a signal feeding line through a signal guiding passage. In an embodiment, a recess is preformed on the external surface of the casing and then a surface antenna pattern is coated to the recess. The antenna device may further comprise an antenna coupling element arranged at the internal surface of the casing, in opposite to the surface antenna pattern. The antenna coupling element is inductively coupled with the surface antenna pattern for transceiving the signals to the electronic device.

4 Claims, 11 Drawing Sheets

U.S. PATENT DOCUMENTS

| | | | | |
|---|---|---|---|---|
| 2004/0051670 | A1 | 3/2004 | Sato | |
| 2005/0001767 | A1 | 1/2005 | Wulff et al. | |
| 2005/1009375 | | 5/2005 | Cheng et al. | |
| 2005/0146475 | A1 | 7/2005 | Bettner | |
| 2006/0244663 | A1* | 11/2006 | Fleck et al. | 343/700 MS |
| 2007/0216582 | A1 | 9/2007 | Cheng et al. | |
| 2007/0247374 | A1* | 10/2007 | Nishikido et al. | 343/702 |
| 2007/0290925 | A1* | 12/2007 | Dijkstra | 343/700 MS |
| 2008/0018551 | A1 | 1/2008 | Cheng et al. | |

FOREIGN PATENT DOCUMENTS

| | | | |
|---|---|---|---|
| DE | 102007006463 | A1 | 9/2007 |
| DE | 102007008566 | A1 | 9/2007 |
| DE | 102007008575 | A1 | 9/2007 |
| DE | 102007011549 | A1 | 10/2007 |
| EP | 1439603 | A1 | 7/2004 |
| EP | 1667282 | A1 | 6/2006 |
| EP | 1686651 | A2 | 8/2006 |
| JP | 58087818 | A | 5/1983 |
| TW | 490880 | | 6/2002 |
| TW | I248700 | | 2/2006 |
| TW | 200709494 | | 3/2007 |

OTHER PUBLICATIONS

Y.Q. Wang et al, "Polymer Modification by Ion Implantation: Ion Bombardment and Characterization," Desk Reference of Functional Polymers Syntheses and Applications, American Chemical Society, pp. 371-385, Washington DC,1997.

Ryan E. Griedd et al, "Electrical and Optical Behavior of Ion-Implanted and Ion-Beam Mixed Polymers," SPIE vol. 3413, pp. 27-36, Quebec, Canada, Jul. 1998.

Y.Q. Wang et al, "Ion Beam Modification and Analysis of Metal/Polymer bi-layer thin films," Nuclear Instruments and Methods in Physics Reasearch, B 219-220, pp. 798-803, 2004 Elsevier B.V.

* cited by examiner

ANTENNA DEVICE WITH SURFACE ANTENNA PATTERN INTEGRALLY COATED CASING OF ELECTRONIC DEVICE

FIELD OF THE INVENTION

The present invention relates to an antenna device used in wireless technology, and in particular to an antenna device with a surface antenna pattern formed by film coating on the casing of an electronic device.

BACKGROUND OF THE INVENTION

It is well known that an antenna is the key element to transmit/receive (transceive) microwaves in wireless technology such as wireless communication and wireless data transfer, where the antenna transforms electrical currents generated by a transmitter into microwaves and transmits the microwaves in free space. The antenna also captures microwaves and transforms them into electrical currents, which are then processed by a receiver. As a result, the characteristics of the antenna deeply affect the application of the wireless technology, and the antenna is one of the factors that determine the quality of the wireless technology.

Among numerous kinds of electronic devices utilizing wireless signal transceiving, the structure, material and dimension of the antennas used by such devices are not entirely the same. A good antenna not only matches the features of the electronic devices and enhances the quality of the transceiving of a wireless signal, but also reduces the manufacturing costs of the electronic devices.

There are various types of antenna devices in the market for electronic devices. Some of the antenna devices are simple in structure, like dipole antennas, flat antennas and PIFA antennas; some are more complicated in structure, like antenna arrays and smart antennas.

As shown in FIG. 1, which shows the conventional arrangement of the antenna used in an electronic device, an electronic device, which is generally denoted a numeral reference 1, includes a casing 11. An antenna 12 and a display module screen 13 are mounted to an interior of the casing 11. An anti-Electromagnetic Interference (anti-EMI) plate 14 is arranged at a space between the casing 11 and the display module screen 13. The antenna 12 is electrically connected to an antenna module 161 of a motherboard 16 of the electronic device 1 by an antenna signal feeding line 17. The electronic device 1 also comprises a conventional pivot mechanism for attaching a lower side of the casing 11 to a rear side of the electronic device 1.

Conventionally, the antenna is mounted to a predetermined position at the casing of the electronic device. Although some antennas are designed to be embedded in the electronic devices, these antennas are manufactured separately and then mounted to predetermined positions inside the electronic devices and electrically connected to the circuit boards of the electronic devices. Such production processes are not only troublesome, but also increase the manufacturing costs and time. Furthermore, after assembling the antennas to the electronic devices, it is needed to adjust the antennas in order to optimize the performance of the antennas.

Thus, it is desired to provide an antenna device that is integrally formed on the casing of the electronic device to simplify the manufacturing processes and reduces the manufacturing cost and time.

SUMMARY OF THE INVENTION

A primary object of the present invention, therefore, is to provide an integrally formed antenna device which is simple in structure.

Another object of the present invention is to provide an antenna device with a surface antenna pattern formed by film coating technology. The film coating technology may comprise dip coating, electroplating and sputtering. The surface antenna pattern is formed either on the external surface or on the internal surface of the casing of the electronic device.

A further object of the present invention is to provide an antenna device comprising a surface antenna pattern and an antenna coupling element. The surface antenna pattern is inductively coupled with the antenna coupling element, and thereby wireless signals is transmitted from the surface antenna pattern through the antenna coupling element to the electronic device.

To realize the above objects, the present invention provides an antenna device with a surface antenna pattern formed on a casing of an electronic device by film coating technology. In the preferred embodiment, the surface antenna pattern may be arranged either on an external surface or on an internal surface of the casing of the electronic device. The surface antenna pattern is either directly connected to a signal feeding line or connected to a signal feeding line through a signal guiding passage. In an embodiment, a recess is formed on the external surface of the casing and then a surface antenna pattern is coated to the recess by film coating.

Preferably, the antenna device further comprises an antenna coupling element arranged at the internal surface of the casing, in opposite to the surface antenna pattern. The antenna coupling element is inductively coupled with the surface antenna pattern for transceiving the signals to the electronic device.

In comparison with the conventional technologies, the present invention provides an antenna device which is directly formed on the casing. The antenna device is not manufactured separately. Accordingly, it is not needed to assemble the antenna device to the electronic device and it is not needed to adjust the antenna device. Advantageously, the manufacturing cost and time can be saved. In the present invention, the signals transceived by the surface antenna pattern can be transmitted by inductively coupling with an antenna coupling element to the electronic device.

These and other objects, features and advantages of the invention will be apparent to those skilled in the art, from a reading of the following brief description of the drawings, the detailed description of the preferred embodiment, and the appended claims.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
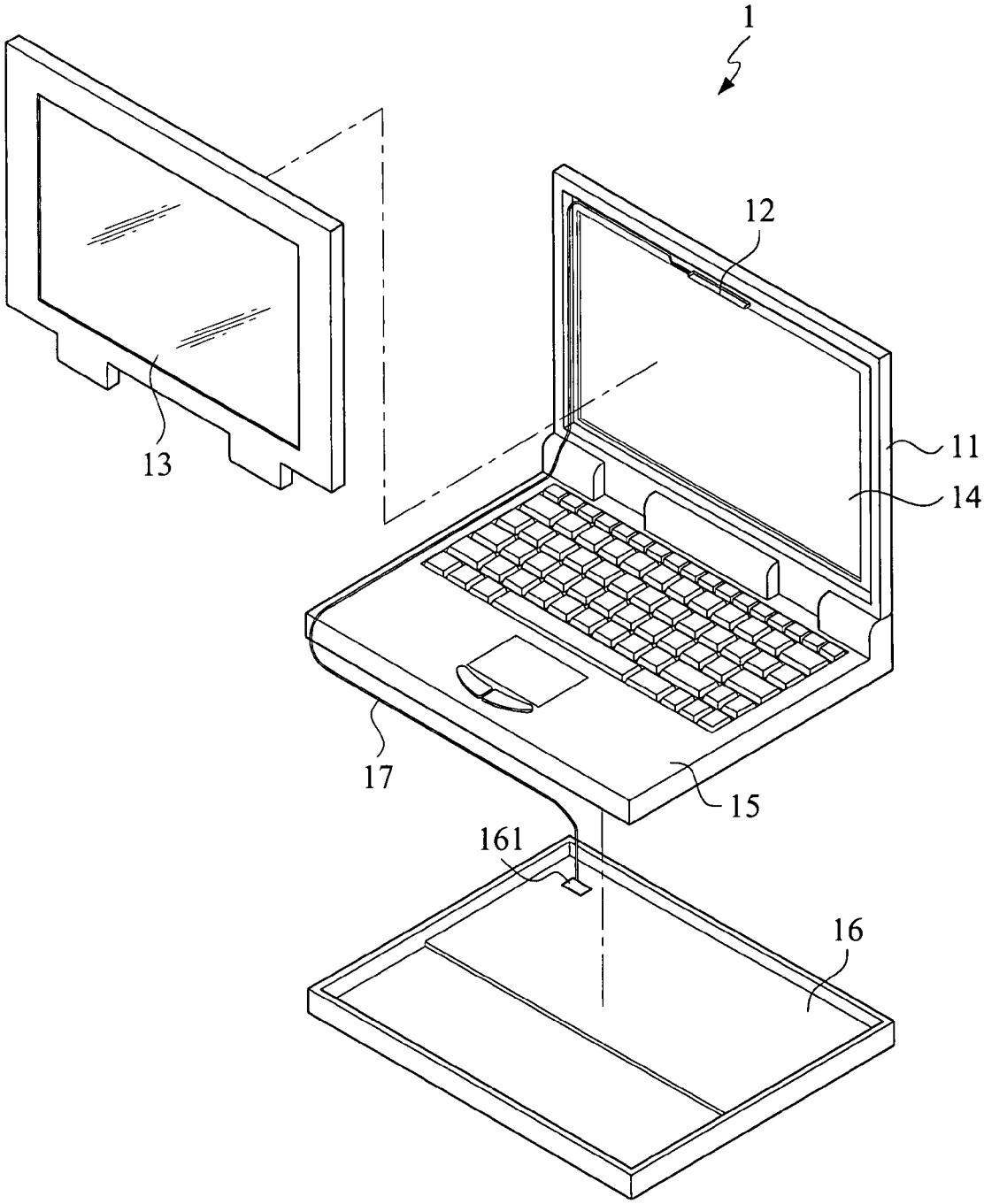
FIG.1(Prior Art)
FIG. 1 is an exploded perspective view of the conventional arrangement of the antenna used in an electronic device.
Figure 2:
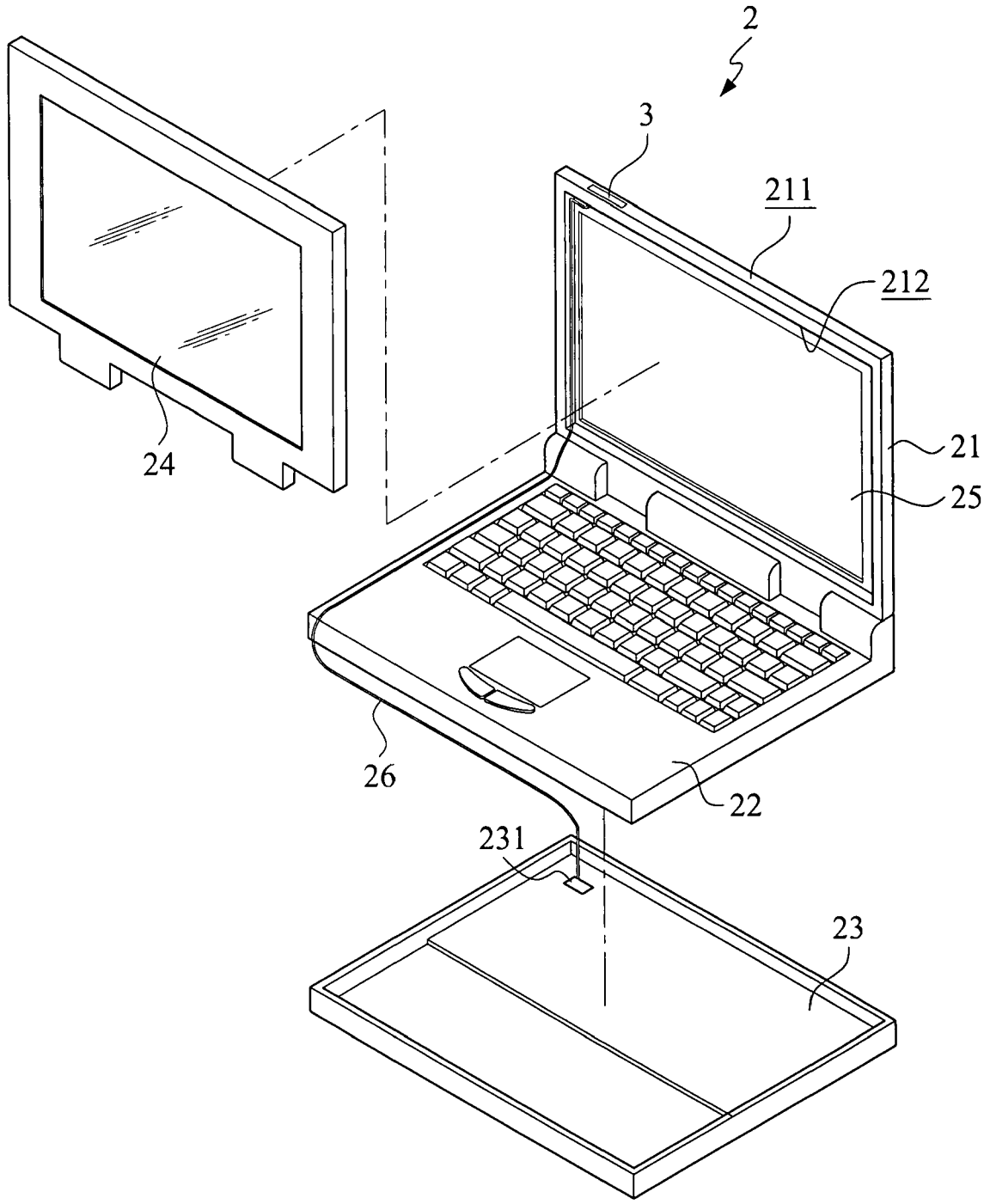
FIG. 2 is an exploded perspective view of an antenna device with a surface antenna pattern in accordance with a first embodiment of the present invention.
Figure 3:
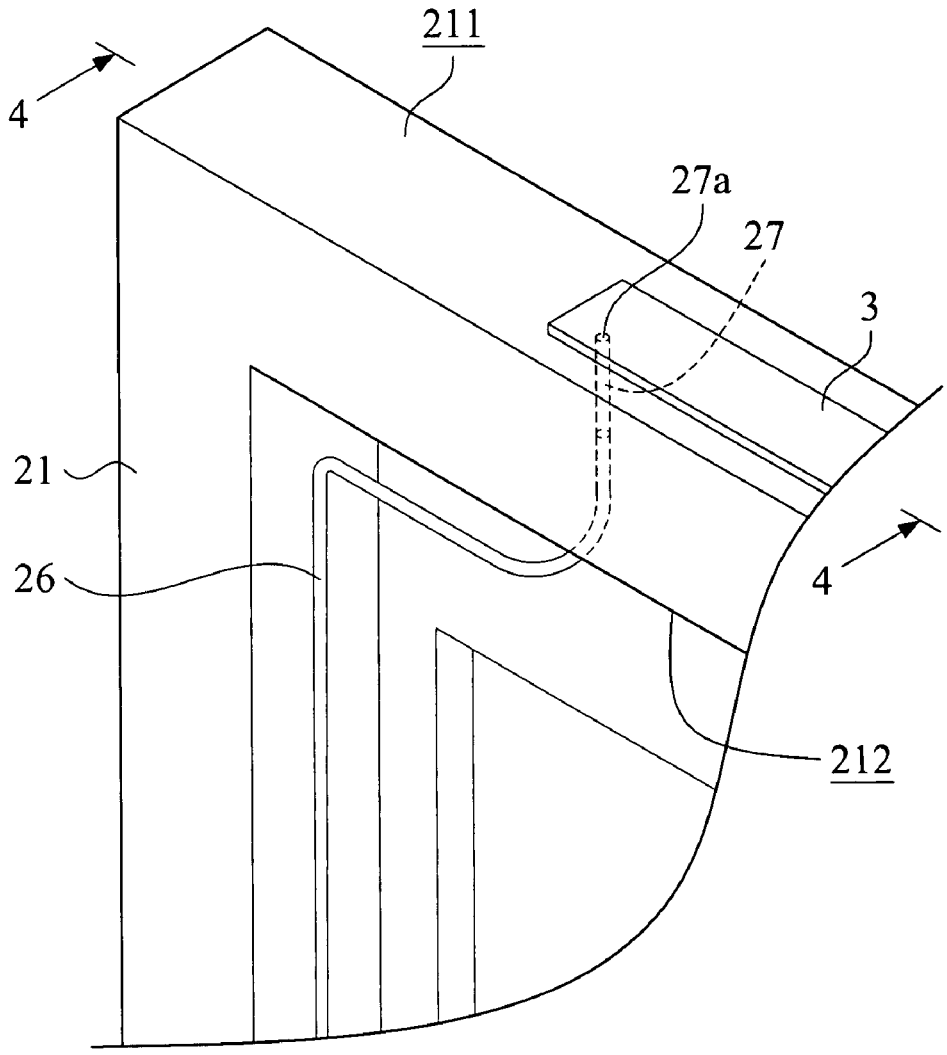
FIG. 3 is a partly enlarge view of the antenna device with a surface antenna pattern in accordance with the first embodiment of the present invention.
Figure 4:
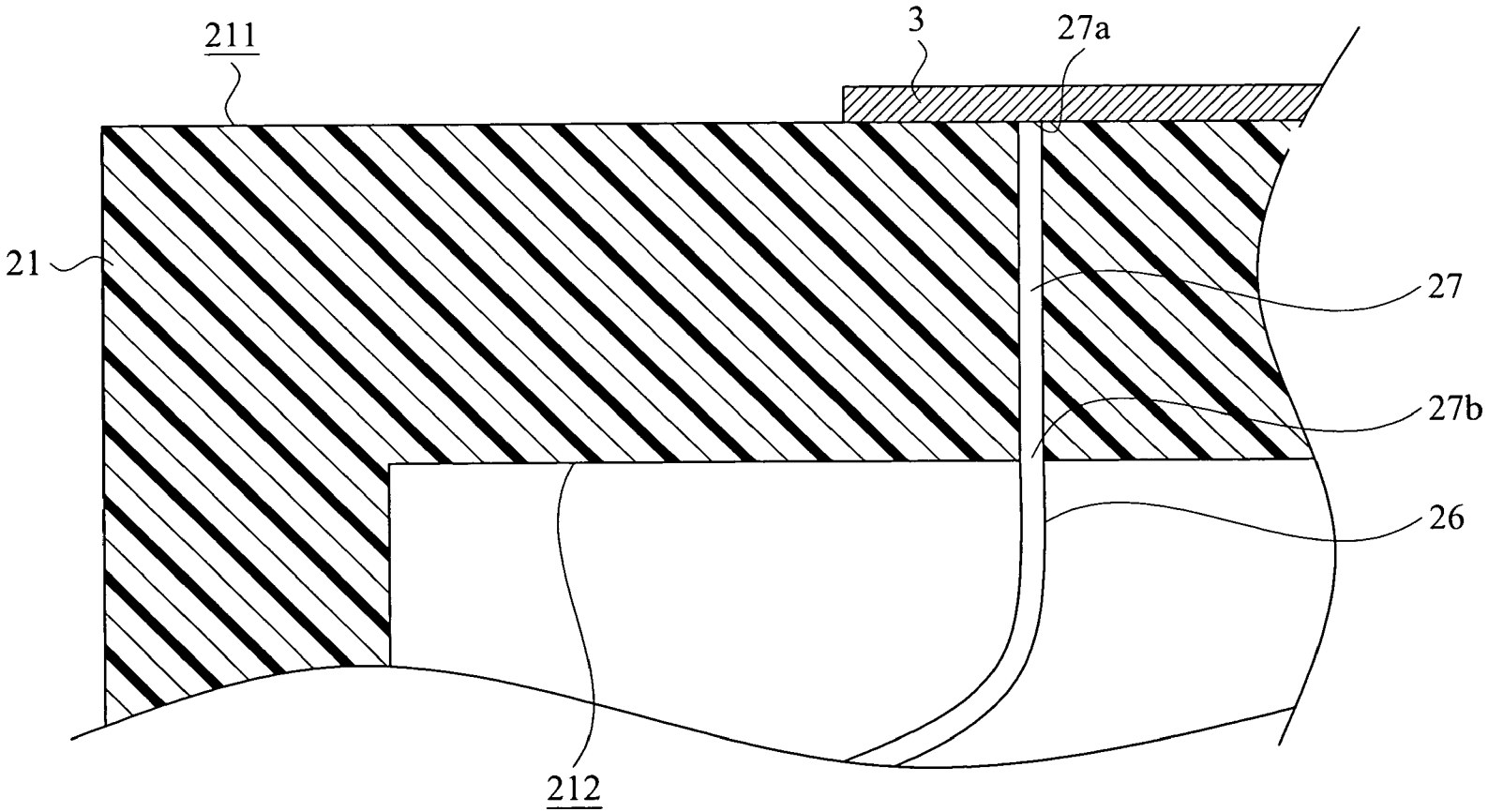
FIG. 4 is a sectional view taken along line 4-4 of FIG. 3.

With reference to the drawings and in particular to FIGS. 2 and 3 that is an exploded perspective view and a partly enlarged view, respectively, of an antenna device with a surface antenna pattern in accordance with a first embodiment of the present invention, and to FIG. 4 that is a sectional view taken along line 4-4 of FIG. 3, the antenna device of the present invention includes a surface antenna pattern 3 arranged at a predetermined position of an electronic device 2. The electronic device 2 comprises a display module casing 21 and a main body casing 22. The electronic device 2 is provided with a conventional pivot mechanism for integrating the rear side of the main body casing 22 to the lower side of the display module casing 22, such that the display module casing 21 is rotatably operable around the pivot mechanism to cover the main body casing 22.

The surface antenna pattern 3 is formed at a predetermined position at an external surface 211 of the display module casing 21 by film coating technology which may comprise dip coating, electroplating, sputtering and any coating techniques.

In a preferred embodiment, the electronic device 2 is a portable personal computer (i.e. a notebook), comprising a motherboard 23 mounted to an internal space of the main body casing 22. The motherboard 23 has an antenna module 231 which is electrically connected to the antenna pattern 3 by an antenna signal feeding line 26. The internal surface 212 of the display module casing 21 defines an inner space for the mounting of a LCD display screen 24. An anti-EMI plate 25 is disposed between the display module casing 21 and the LCD display screen 24.

The surface antenna pattern 3 coated at the external surface 211 of the display module casing 21 is electrically connected to the antenna module 231 through the antenna signal feeding line 26. The wireless signals transceived by the surface antenna pattern 3 is transmitted through the antenna signal feeding line 26 to the motherboard 23 at the main body casing 22.

As shown, the surface antenna pattern 3 is coupled to the antenna signal feeding line 26 through a signal guiding passage 27. The signal guiding passage 27 comprises a signal feeding end 27*a* and a connecting end 27*b*. The signal feeding end 27*a* is electrically connected to the surface antenna pattern 3. The connecting end 27*b* passes through the display module casing 21 to the inner surface 212 of the display module casing 21, and is electrically connected with the signal feeding line 26. Through the signal feeding line 26, the wireless signals transceived by the surface antenna pattern 3 is transmitted to the electronic device 2. The signal guiding passage 27 may be formed by electroplating an electrically conductive material, e.g. tin, to a through-hole arranged at the display module casing 21. Alternatively, the signal guiding passage 27 may be formed of an electrically conductive material e.g. an electric wire for connecting the surface antenna pattern 3 to the signal feeding line 26.

Figure 5:
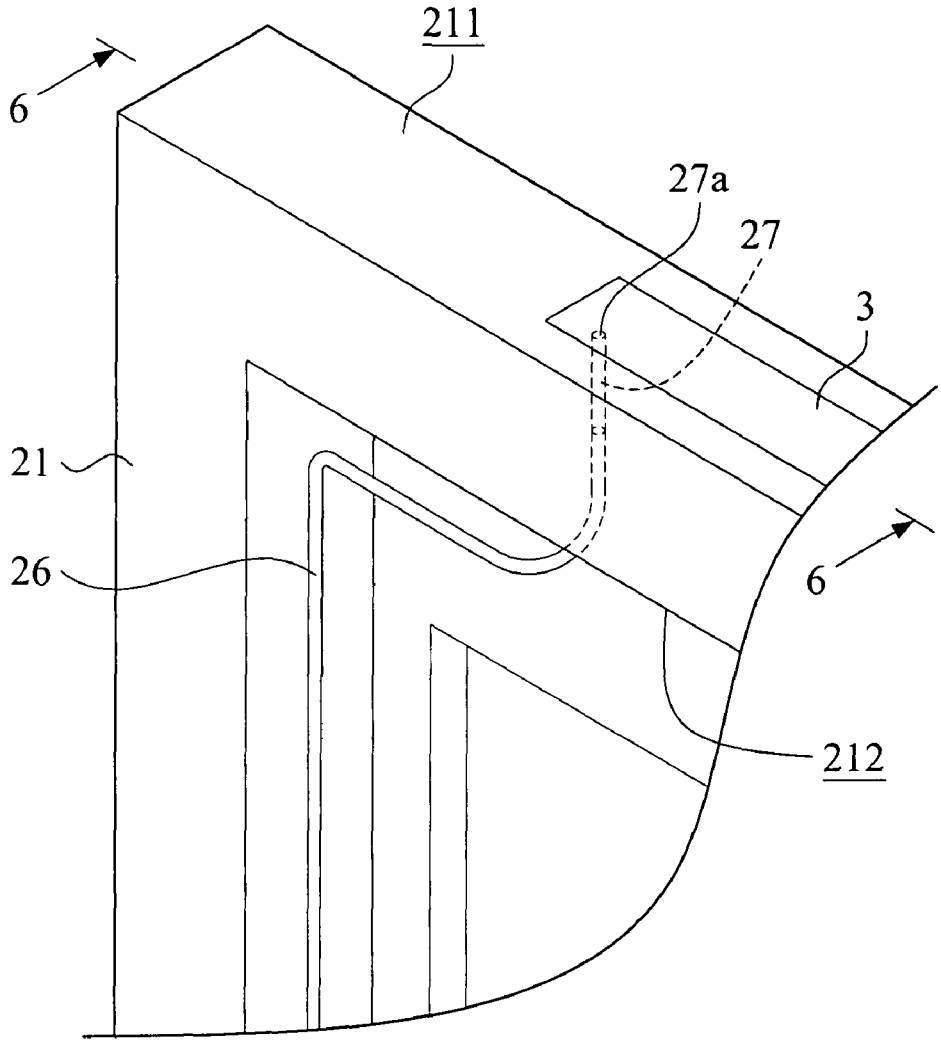
FIG. 5 is a partly enlarged view of an antenna device with a surface antenna pattern in accordance with the second embodiment of the present invention.
Figure 6:
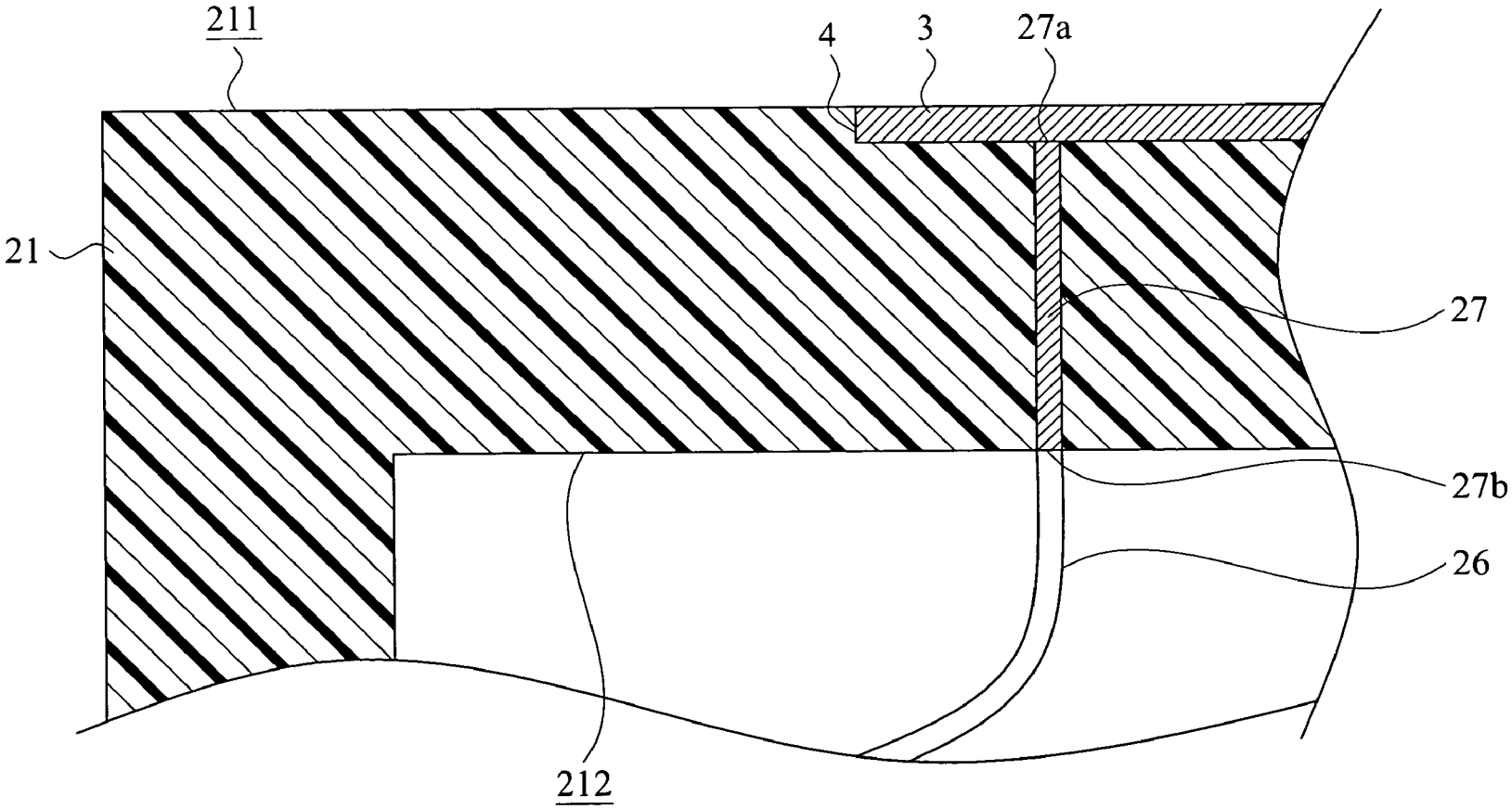
FIG. 6 is a sectional view taken along line 6-6 of FIG. 5.

FIG. 5 is a partly enlarged view of an antenna device with a surface antenna pattern in accordance with the second embodiment of the present invention and FIG. 6 is a sectional view taken along line 6-6 of FIG. 5. The second embodiment is different from the first embodiment in that in the first embodiment, the surface antenna pattern is formed by film coating on the external surface at of the display module casing, and in the second embodiment, the surface antenna pattern is formed by film coating in a recess of the display module casing. As shown in the drawings, the external surface 211 of the casing 21 is pre-formed with a recess 4. Then, a surface antenna pattern 3 is formed on the recess 4 of the display module casing 21 by film coating. The film coating technology may comprise dip coating, electroplating, sputtering and any coating techniques. The surface antenna pattern 3 has a thickness that is equal to the depth of the recess 4, such that the top surface of the surface antenna pattern 3 and the external surface 211 of the display module casing 21 form a continuous flat plane.

Figure 7:
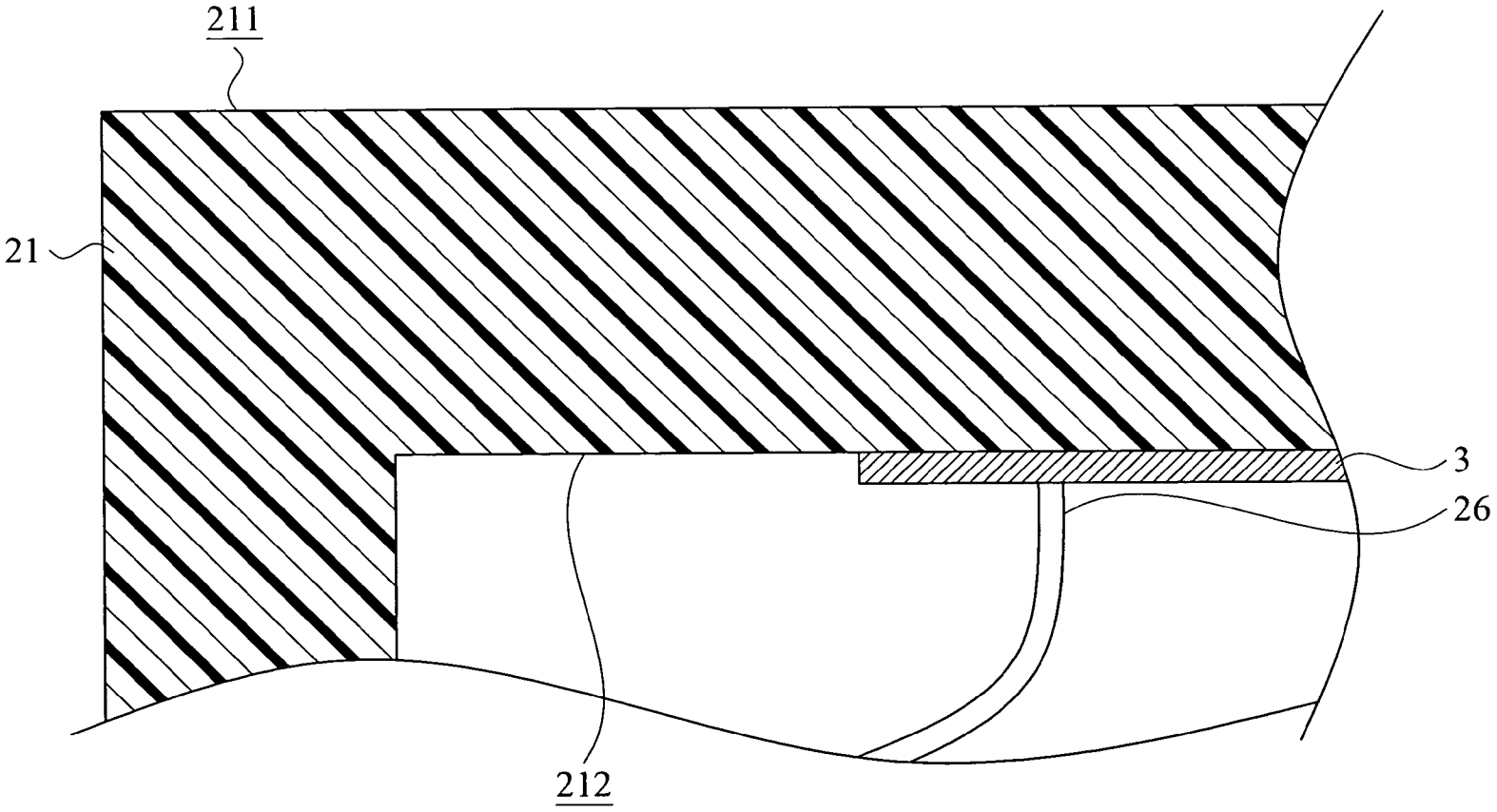
FIG. 7 is a sectional view of an antenna device with a surface antenna pattern in accordance with a third embodiment of the present invention.

FIG. 7 is a sectional view of an antenna device with a surface antenna pattern in accordance with a third embodiment of the present invention. The third embodiment is different from the first embodiment in that in the first embodiment, the surface antenna pattern is formed by film coating on the external surface of the display module casing, and in the third embodiment, the surface antenna pattern is formed by film coating on the internal surface of the display module casing. It can be seen from FIG. 7 that a surface antenna pattern 3 is coated on the internal surface 212 of the display module casing 3, which is then directly electrically connected to the signal feeding line 26. The surface antenna pattern 3 is equally effective in transceiving wireless signals.

Figure 8:
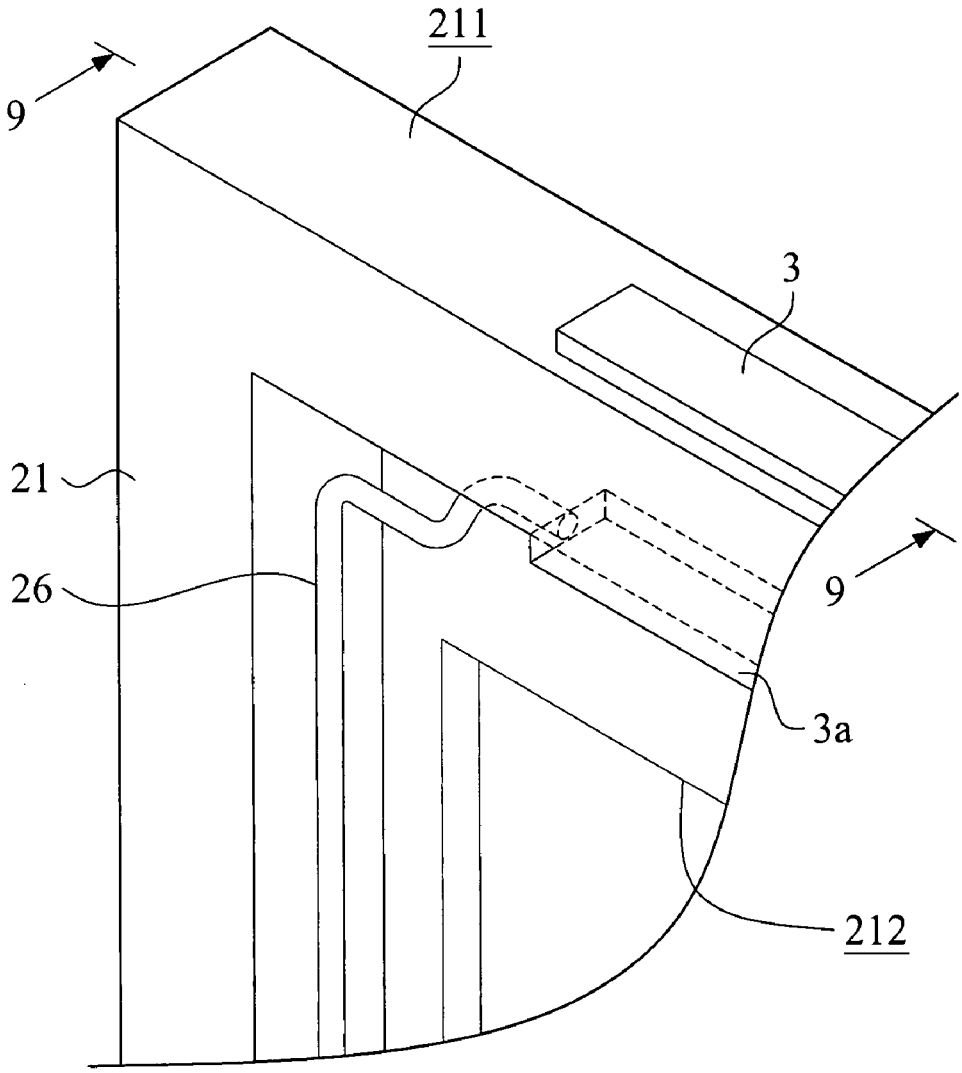
FIG. 8 is a partly enlarged view of an antenna device with a surface antenna pattern in accordance with a fourth embodiment of the present invention.
Figure 9:
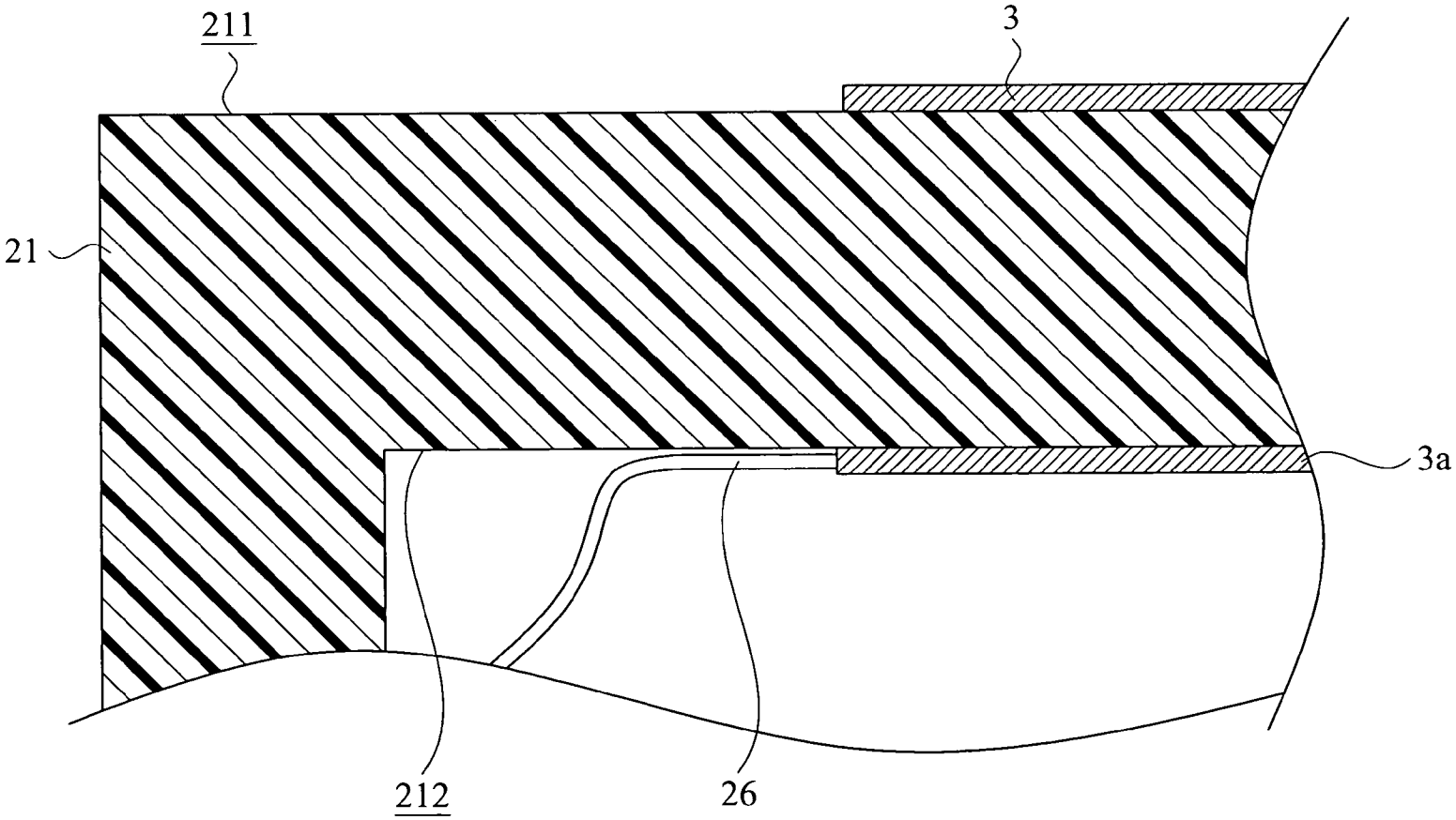
FIG. 9 is a sectional view taken along line 9-9 of FIG. 8.

FIG. 8 is a partly enlarged view of an antenna device with a surface antenna pattern in accordance with a fourth embodiment of the present invention and FIG. 9 is a sectional view of the antenna device of FIG. 8. The surface antenna pattern 3 of the fourth embodiment is similar to that of the first embodiment, which is formed on the external surface 212 of the display module casing 21 by film coating. However, in the fourth embodiment, the antenna device further comprises an antenna coupling element 3*a* which is electrically connected to the antenna signal feeding line 26. The antenna coupling element 3*a* is arranged at a position at the internal surface 212 of the display module casing 21 directly opposite to the surface antenna pattern 3 at the external surface 211 of the display module casing 21.

The antenna coupling element 3*a* is inductively coupled with the surface antenna pattern 3 (with no direct wire connection) for transceiving wireless signals. The wireless signals received by the surface antenna pattern 3 are transmitted through the antenna coupling element 3*a* and the antenna signal feeding line 26 to the antenna module 231 of the electronic device 2; the signals from the electronic device 2 are transmitted through the antenna module 231, the antenna signal feeding line 26 and the antenna coupling element 3*a* to the surface antenna pattern 3 where the signals are sent out wirelessly.

Figure 10:
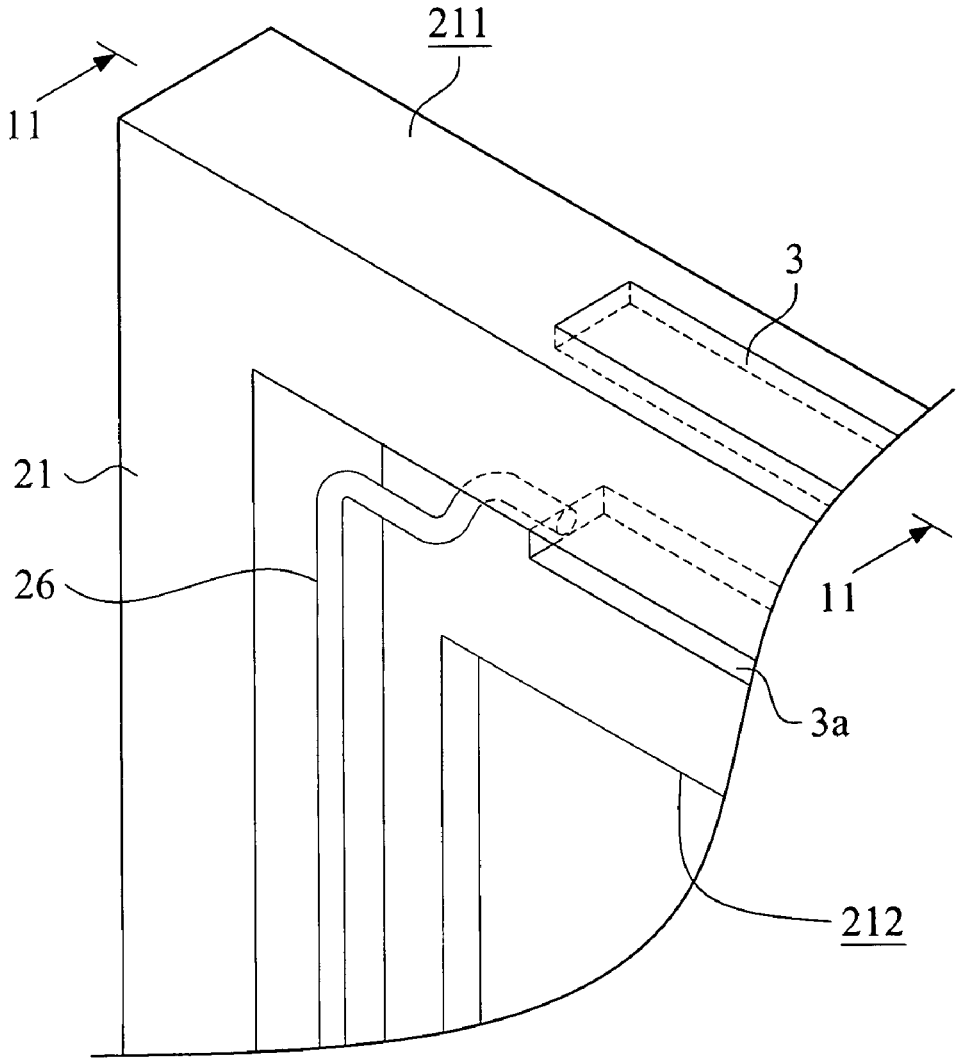
FIG. 10 is a partly enlarged view of an antenna device with a surface antenna pattern in accordance with a fifth embodiment of the present invention.
Figure 11:
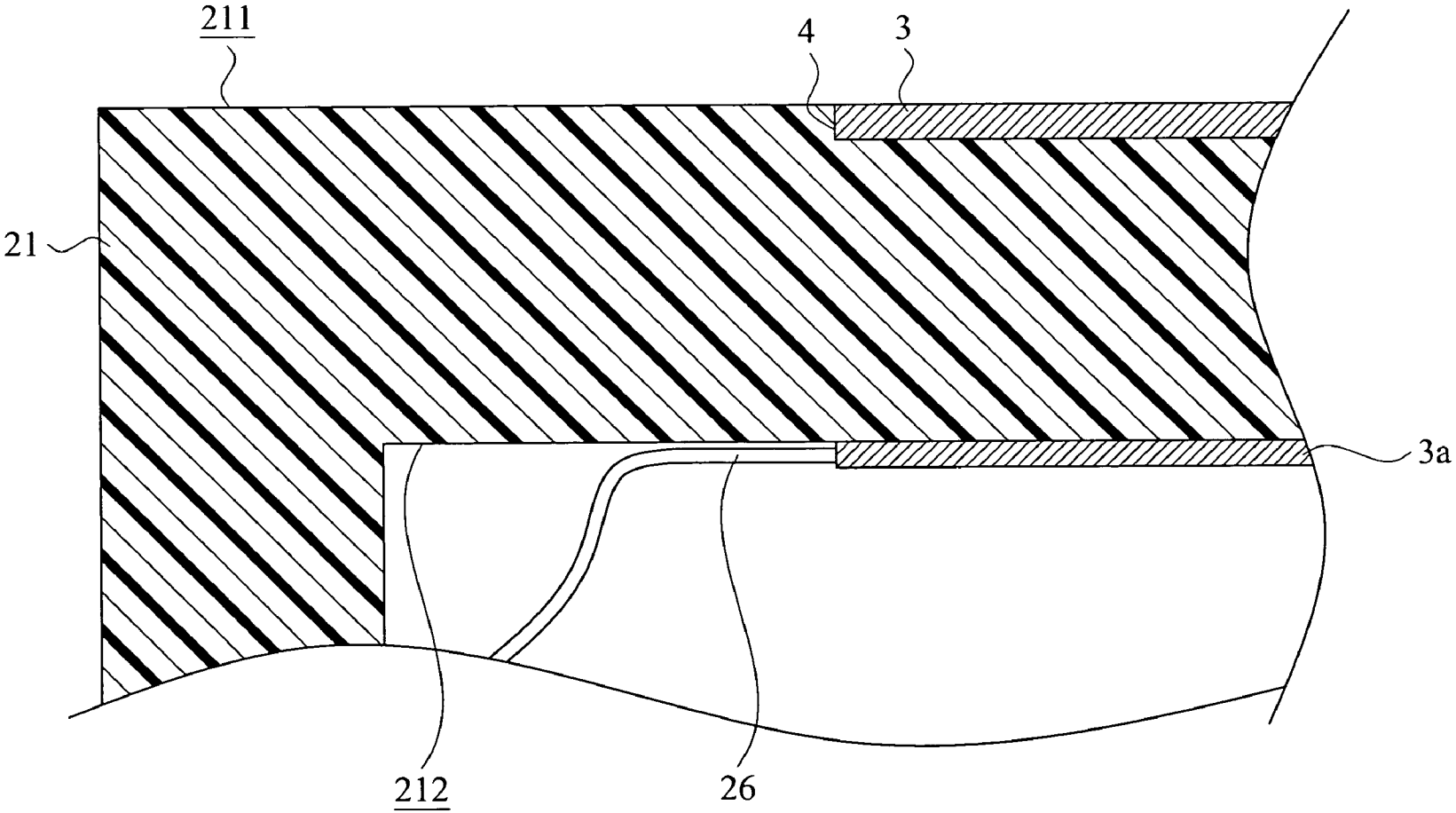
FIG. 11 is a sectional view taken along line 11-11 of FIG. 10.

FIG. 10 is a partly enlarged view of an antenna device with a surface antenna pattern in accordance with a fifth embodiment of the present invention and FIG. 11 is a sectional view taken along line 11-11 of FIG. 10. The fifth embodiment is similar to the fourth embodiment, except that the surface antenna pattern is formed by film coating on a recess of the display module casing. As shown in the drawings, the external surface 211 is pre-formed with a recess 4. Then, a surface antenna pattern 3 is formed on the recess 4 of the display module casing 21 by film coating. The antenna coupling element 3*a* is arranged at the internal surface 212 of the display module casing 3 directly opposite to the surface antenna pattern 3 and is connected through the antenna signal feeding line 26 to the antenna module 231 of the electronic device 2.

From the above statement, the present invention directly forms a surface antenna pattern on the casing of an electronic device by film coating accompanying a direct wire connection or a coupling feeding. Further, the present invention can be adapted into a wide range of electronic devices when used in different fields of application.

While the invention has been described in connection with what is presently considered to the most practical and preferred embodiments, it is to be understood that the invention is not to be limited to the disclosed embodiments, but on the contrary, is intended to cover various modifications and equivalent arrangement included within the spirit and scope of the appended claims.

What is claimed is:

1. An electronic device comprising:

a casing with an internal surface and an external surface; and an antenna device, comprising:

a surface antenna pattern, which is formed by film coating technology on the external surface of the casing of the electronic device for transceiving a wireless signal of a predetermined radiation frequency;

a signal guiding passage comprising an electroplated through-hole passing through the casing from the external surface to the internal surface, the signal guiding passage having a signal feeding end at the external surface electrically connecting to the surface antenna pattern and a connecting end at the internal surface; and an antenna signal feeding line, which is electrically connected between the connecting end of the signal guiding passage and an antenna module of the electronic device for feeding the wireless signal transceived by the surface antenna pattern to the antenna module of the electronic device, wherein the surface antenna pattern is formed by film coating technology selected from the group of dip coating, electroplating and sputtering.

2. The antenna device as claimed in claim 1, wherein the surface antenna pattern is formed on a recess pre-formed at the external surface of the casing.

3. The antenna device as claimed in claim 1, wherein the electronic device is a portable personal computer and the casing is a display module casing for the mounting of a LCD display.

4. The antenna device as claimed in claim 1, wherein the surface antenna pattern has an edge portion at a perimeter thereof and an interior portion inside the edge portion, and wherein the signal feeding end and the connecting end of the signal guiding passage are formed in a portion of the casing completely covered by the interior portion of the surface antenna pattern.

* * * * *